US007145109B2

(12) United States Patent
Wilde et al.

(10) Patent No.: US 7,145,109 B2
(45) Date of Patent: Dec. 5, 2006

(54) APPLIANCE FOR SWITCHING ON AND OFF SEVERAL HEATING DEVICES OF A COOKER, AS WELL AS COOKER HAVING SUCH AN APPLIANCE

(75) Inventors: Eugen Wilde, Knittlingen (DE); Erich John, Pforzheim (DE); Hans Mohr, Sulzfeld (DE); Ralf Stoll, Bruchsal (DE)

(73) Assignee: E.G.O. Elektro-Geraerebau GmbH (DE)

( * ) Notice: Subject to any disclaimer, the term of this patent is extended or adjusted under 35 U.S.C. 154(b) by 43 days.

(21) Appl. No.: 10/910,434

(22) Filed: Aug. 3, 2004

(65) Prior Publication Data

US 2006/0027563 A1 Feb. 9, 2006

(51) Int. Cl.
*H05B 1/02* (2006.01)

(52) U.S. Cl. ..... 219/492; 219/497

(58) Field of Classification Search ..... 219/490–497, 219/501, 507, 511–512, 448.12, 462.1
See application file for complete search history.

(56) References Cited

U.S. PATENT DOCUMENTS 4,633,238 A 12/1986 Goessler et al.
5,498,853 A 3/1996 Gross et al.
6,064,045 A 5/2000 Reichert et al.
6,951,997 B1 * 10/2005 Larson et al. ..... 219/492

FOREIGN PATENT DOCUMENTS

DE 10 2004 020 977 A 4/2004

* cited by examiner

*Primary Examiner*—Tu Hoang
(74) *Attorney, Agent, or Firm*—Akerman Senterfit

(57) ABSTRACT

An appliance for a hotplate has two heating devices installed parallel to one another. With an energy control device and as a function of an angular position, either a first heating device is operated in controlled manner or a second heating device is connected thereto in fixed form. The power of the second heating device is defined so low that no temperature limiter for protecting a glass ceramic plate has to be provided in the control path of the second heating device. On connecting in the second heating device, the controlled power of the first heating device is lowered to an initial value by roughly the amount of the power of the second heating device. The total power results from the summated power of the two heating devices.

13 Claims, 3 Drawing Sheets

APPLIANCE FOR SWITCHING ON AND OFF SEVERAL HEATING DEVICES OF A COOKER, AS WELL AS COOKER HAVING SUCH AN APPLIANCE

BACKGROUND FOR THE INVENTION

Field of Application and Prior Art

The invention relates to an appliance for switching on and off several heating devices of a cooker, as well as to a cooker having such an appliance.

Radiant heaters with a certain diameter, which for example exceeds 230 mm, suffer in part from the problem that their energy supply through so-called energy or power control devices on the one hand and an excess temperature protection for a glass ceramic plate over the radiant heater through so-called temperature limiters on the other are limited by the maximum power levels which can be applied and by a so-called flicker standard. The flicker standard indicates how frequently in a specific time period a particular power can be switched on and off in a cooker and is intended to prevent significant network reactive effects in line with the power supply companies.

The switching capacity both of the power or energy control devices and the temperature limiters, which operate with so-called snap-action switches, such as for example described in U.S. Pat. Nos. 6,064,045 and 4,633,238, is generally limited. For the USA it is for example 12 or 13 Ampere, so that 100,000 switching cycles must be attainable.

With the conventionally predetermined mains voltage, a further increase of the power of a radiant heater is consequently impossible.

Problem and Solution

The problem of the invention is to provide the aforementioned appliance, together with a cooker, with which the prior art disadvantages can be avoided and in particular the activation of a further heating device for increasing the heating power of a heater of a hotplate can be brought about for minimum cost.

This problem is solved by an appliance for switching on and off several heating devices of a cooker, the heating devices being located on the cooker, with the appliance having a cyclic energy control device for adjusting the cycle times of a first heating device. The energy control device has a first switching device with a tripping path and a first tripping point for the first switching device and a second switching device with a second tripping path and a second tripping point for the second switching device and a spacing change for the first and second tripping paths of the switching devices. The energy control device has a mechanism for an adjusting path for influencing the spacing change, the two tripping paths defining on or off times of the switching devices or a mutual ratio of the on or off times and at the second tripping point of the second tripping path. The second switching device for the second heating device is activated or switched on through the adjusting path. The problem may also solved by a cooker having such an appliance, and having a hob with a glass ceramic plate and radiant heaters as the heating devices below the glass ceramic plate, the second heating device having a maximum continuous output power of approximately 2.5 W/cm$^2$. By express reference the wording of the claims is made into part of the content of the description. In the sense of the present application the word "have" means that this feature can be inter alia provided, independently of other features.

According to the invention this problem is solved in that the appliance has a cyclic energy control device, such as is for example known from U.S. Pat. No. 6,064,045, which has a distance change for a tripping path of a first switching device contained in the power control device. The spacing change can in turn be influenced by the adjusting path covered on the energy control device, for example by a rotary movement using a rotary toggle or knob of the energy control device. In turn the tripping path defines the on or off times or their mutual ratio, with which the heating device is either deactivated or activated with full power. As a result of the timing or cyclic ratio or the length of the on and off times, the so-called averaged energy generation can take place and there is also a so-called average power. At one point of the tripping path is provided a second tripping point, where a second switching device is activated or switched on and with which a second heating device can be activated. This second heating device is advantageously an additional heater relative to the first heating device.

If the two heating devices form a hotplate, it is possible in this way for the power of the second heating device not to have to be switched by means of the same first switching device, which also switches the first heating device. This permits higher heating powers in a hotplate than have hitherto been possible.

Advantageously the spacing change is such that, at the second tripping point, it sets the tripping path for the first switching device at an initial value again for the definition of the on and off times and the mutual ratio thereof and as from this point with a further increasing adjusting path the tripping path is changed again, particularly in the same direction as previously. In other words the spacing change with an overall increasing adjusting path the tripping path rises from an initial value to the second tripping point and consequently correspondingly influences the first switching device. At the second tripping point, by means of the second switching device, the second heating device is activated in addition to the first heating device. The trip for the first heating device is reset again and therefore so is its average power output over and beyond a certain time, for example in the case of a cooker is set to a lower stage. Advantageously said second tripping point is positioned so that the average power generated up to just prior to the second tripping point by the first heating device corresponds to that which is then generated by the second heating device. The average power generated by the first heating device as from the second tripping point is once again greatly reduced and starts to rise again with an increasing adjusting path and increasing tripping path. Thus, at the second tripping point a certain constant value of the average power is produced by the second heating device. The variable part, whose level can be influenced via the energy control device at the first heating device then comes in rising manner again from the heating device. An advantage of this arrangement is that only the first heating device has to be timed, namely with a somewhat lower current than corresponds to the total produced average power.

The appliance can have a temperature limiter or can be connected thereto and this is located in the action area of the first heating device and in certain circumstances also in the action area of the second heating device. This temperature limiter can for example be constructed in the manner described in U.S. Pat. No. 4,633,238 and on exceeding a specific temperature and in particular for protecting a glass ceramic plate positioned over the heating device, switches off the first heating device. For this purpose the temperature limiter can have a switch, which is located in the connection path for the first heating device.

As stated hereinbefore, the cyclic energy control device can be constructed in such a way that the adjusting path is influenced by a linear movement or preferably a rotary movement. In the case of a rotary movement it should be somewhat less than 360°. By means of the spacing change the rotary movement is transformed into a substantially linear tripping path. For this purpose the energy control device or the spacing change can for example have a rotary spindle with a non-circular disk, on whose outer edge engages part of a switching device or the first switching device, whose switching behaviour with respect to the on and off times or their mutual ratio is dependent on the variable tripping path, that is the variable radius of the disk. For the second tripping point a similar trip can be provided, in particular once again constituted by a non-circular disk or a type of cam. AT the second tripping point said disk or cam activates the second switching device in order to connect in the second heating device. However, here there is no need for a continuously modified radius, because no increasing path is needed.

The second tripping point, where the second heating device separates the generation of the heating power from the first heating device is preferably such that the average power of the first heating device at this point is less than half the maximum, total power, for example roughly a third. At such a point during cooking processes there is normally the transition between the boiling, for example of liquids, and the frying of for example meat in a pan. The particularly high heating power levels at a hotplate advantageously producible by means of the invention are particularly advantageous for such high power frying processes, in addition to the rapid parboiling of saucepans with water.

In the case of a cooker according to the invention, there can be two heating devices for a hotplate, the cooker having a hob with a glass ceramic plate and radiant heaters below the same, together with several such hotplates. The second heating device has a maximum continuous output power corresponding to a power density of approximately 2.5 W/cmý. At this value the second heating device can generally be operated without any temperature monitoring with respect to the overheating of the glass ceramic plate. Thus, for the second heating device or the operation thereof, there is no need for temperature monitoring with respect to overheating of the glass ceramic. The power density can also be chosen above 2.5 W/cmý, if this is allowed or can be gathered from the glass ceramic manufacturer's specifications or tests.

The two heating devices are advantageously electrically separated from one another. In particular, they are contained in a so-called single circuit heater, as opposed to two-circuit heaters, which permit a size increase of a hotplate for larger cooking vessels. The first and second heating devices can comprise elongated heating resistors, particularly in flat band form, which are installed on a surface in spiral or meander-like form. The two heating devices in the form of heating strips are parallel in each case and cover the same overall surface. Thus, in the case of such a hotplate of a hob the second heating device does not give rise to a larger heating surface and instead there is a greater heating power for the same heating surface.

These and other features can be gathered from the claims, description and drawings and the individual features, in each case singly or in the form of subcombinations, can be implemented in an embodiment of the invention and in other fields and can represent advantageous, independently protectable constructions for which protection is claimed here. The subdivision of the application into individual sections and the subheadings in no way limit the general validity of the statements made thereunder.

BRIEF DESCRIPTION OF THE DRAWINGS

Embodiments of the invention are described hereinafter relative to the diagrammatic drawings, wherein show.

DETAILED DESCRIPTION OF THE EMBODIMENTS

Figure 1:
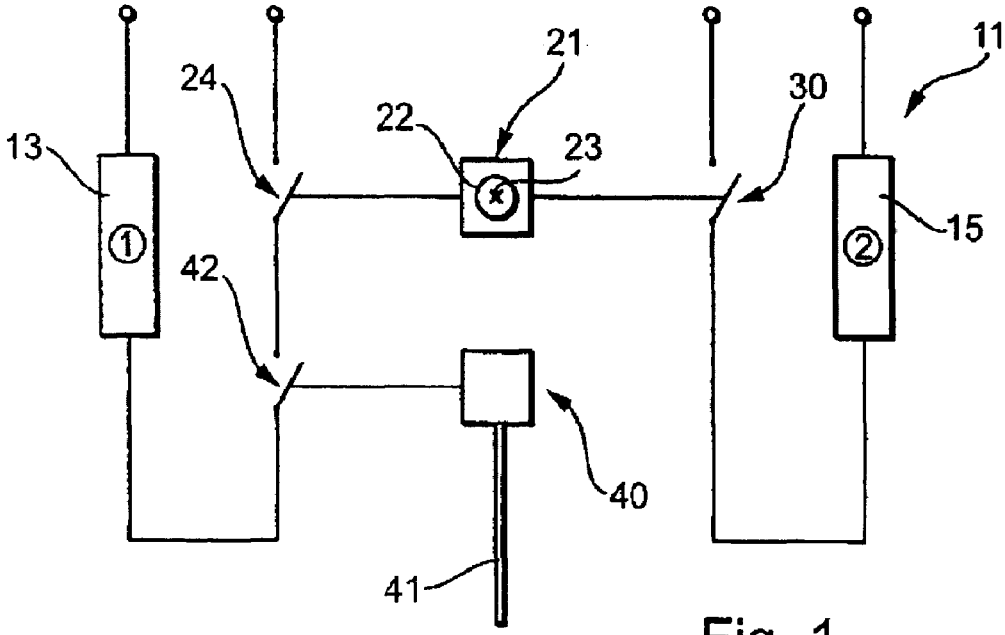
FIG. 1 A diagrammatic circuit arrangement according to one aspect of the invention.
Figure 3:
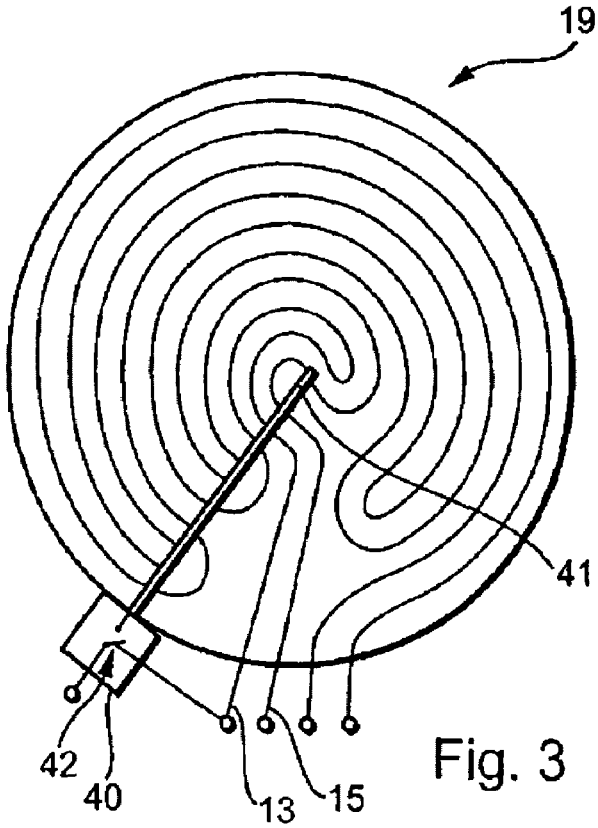
FIG. 3 A plan view of a very basic arrangement of two heating devices at a hotplate of a hob.

FIG. 1 is an operating diagram of an appliance 11 according to the invention enabling the control of a first heating device 13 and a second heating device 15, which form a common hotplate 19, as can be gathered from FIG. 3. It must be borne in mind that the two heating devices 13 and 15 do not form a basic and an additional heating zone, but instead both roughly heat the same surface area. The second heating device 15 serves merely to provide an additional heating power to the surface of the hotplate 19.

Both heating devices 13 and 15 can be so-called radiant heaters, such as are for example described in U.S. Pat. No. 5,498,853 to which express reference is made. They are operated at mains voltage, that is in Germany for example 230V and in the USA 120 to 240V. They are normally operated cyclically, so that a heating device is either applied to the supply voltage and operates at full power or is isolated from the supply voltage and consequently deactivated. The level of the energy generation over and beyond a certain time period does not take place by lowering the supply voltage for continuous operation, but instead by cycles with on times and off times. Through the cyclic ratio or the length of the on and off times, it is possible to obtain so-called averaged energy generation or so-called average power is obtained.

In the present example the first heating device 13 is to be operated cyclically in order to determine the level of the average continuous output power and this also applies to the second heating device 15. An energy control device 21 is provided for controlling the heating devices in the aforementioned cyclic manner with on and off times. A similar energy control device 21 is for example described in U.S. Pat. No. 6,064,045 or DE 102 004 020 977 A, to which reference is expressly made. Through a rotary movement on a toggle 22 by an operator, it is possible to set a particular cooking stage, which determines the level of the average power of the heating devices or the hotplate 19 over and beyond a long period of time. The toggle 22 is located on a rotary spindle 23. As a function thereof, the energy control device 21 switches the first heating device 13 on and off using the first switching device 24.

Figure 2A:
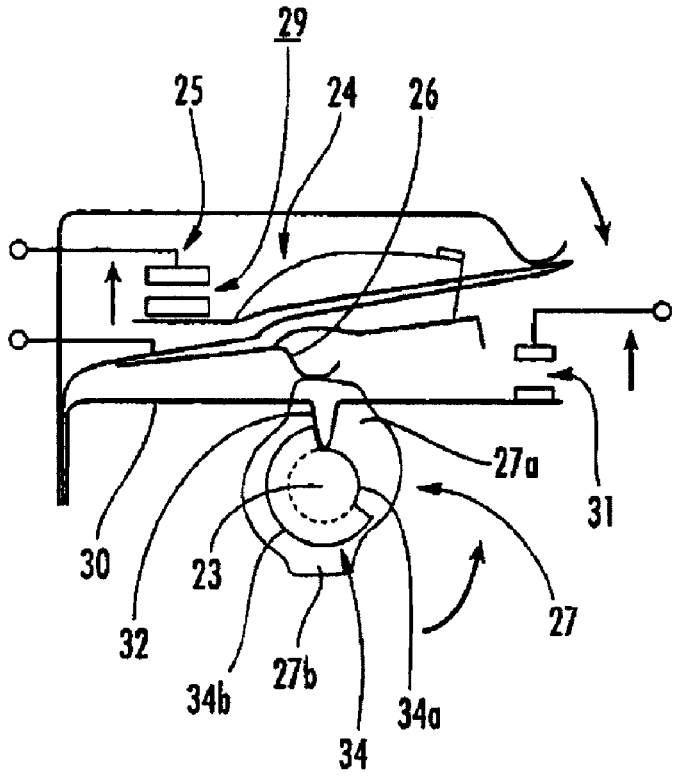
FIGS. 2*a* and 2*b* A diagrammatic arrangement of two cam disks on a rotary spindle of an energy control device with two switching devices.
Figure 2B:
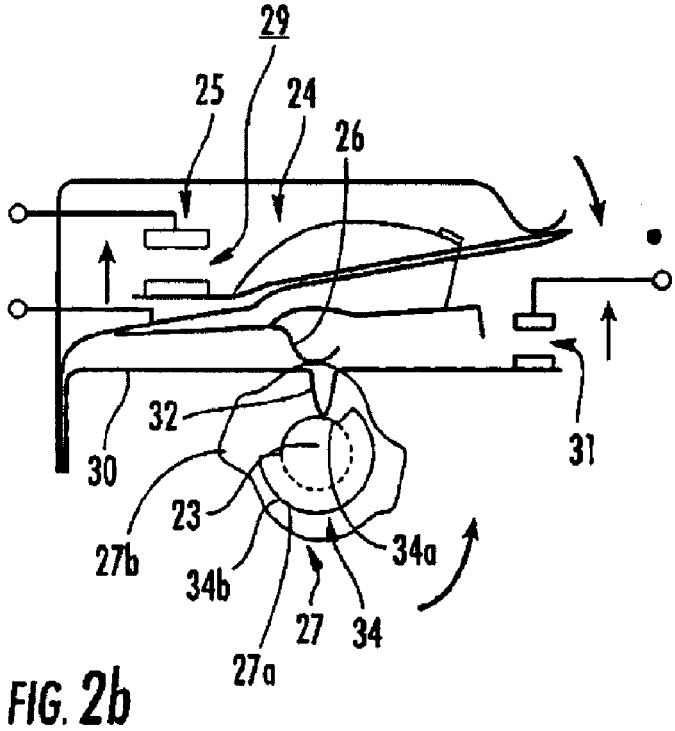

As can be gathered from FIG. 2*a*, for this purpose the rotary spindle 23 carries a first controller drum 27, which has a specific path. On the first controller drum 27 is located a slider 26, which carries the first switching device 24 with the contacts 25. The switching device 24 is constructed as a snap-action switch. FIG. 2*b* shows that the rotary spindle 23 has been turned with an angle of about 80° counter-clockwise. This causes the slider 26 to be pressed against a point at the first controller drum 27 and its distance 29 to the rotary axis of the rotary spindle has been diminished. As such, the first switching device 24 has moved a little, moving the first contact away from the second contact. With regards to the more detailed operation, reference is again made to U.S. Pat. No. 6,064,045 and its content made into part of the content of the present application. The precise form of the first controller drum 27 is also described in greater detail hereinafter.

On the rotary spindle 23 is also provided a cam disk 34, on which engages a slider 32 of a second switching device 30 with contacts 31, which switches on and off the second switching device 15. The precise path of the cam disk 34 is also described in detail hereinafter.

FIG. 3 diagrammatically provides a plan view of the hotplate 19. It is clear that the two heating devices 13 and 15 roughly cover the surface of the hotplate 19 as elongated, parallel heating conductor strips or resistors. In addition, a temperature limiter 40 is provided, such as is for example described in U.S. Pat. No. 4,633,238. It has a long sensor 41 and contains a temperature limiting switch 42. With regards to the precise construction and function reference is made to U.S. Pat. No. 4,633,238, whose content is made into part of that of the present application.

Figure 4:
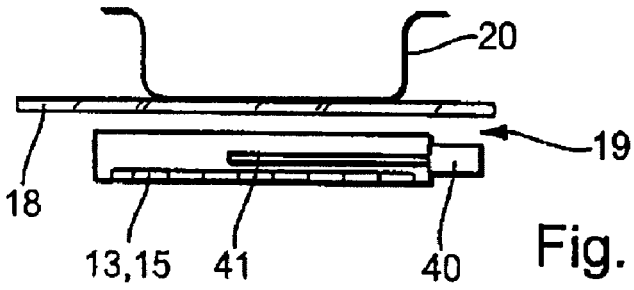
FIG. 4 A side view of the arrangement of FIG. 3 in a hob.

The sensor 41 covers a certain area of the hotplate 19 and runs preferably over a type of free zone between the paths of the first heating device 13 and second heating device 15. However, the temperature limiting switch 42 may only interrupt the supply of the first heating device 13. Thus, it admittedly detects the temperature of the complete hotplate 19, but it only interrupts the energy supply to the first heating device 13 in the case of an excessive temperature or a temperature considered harmful for a covering glass ceramic plate 18 in accordance with FIG. 4.

According to the invention, the second heating device 15 is constructed for a continuous output power not exceeding a value of approximately 2.5 W/cmý on covered surface. For this value it is possible and permitted to permanently operate the second heating device 15 without any possibility of an excess temperature at the glass ceramic plate 18. Thus, no temperature limiter 40 is needed here. The power of the second heating device 15, in addition to the power of the first heating device 13, can give a desired overall power.

The advantage of this subdivision of the total power Pges over the two heating devices is that by means of the energy control device 21 or the two switching devices 24 and 30 contained therein, it is possible to switch on both heating devices 13 and 15 with respect to their cooking stage predetermined by an operator. As the total power of the hotplates 19 is distributed over the two switching devices 24 and 30, no problems arise here with excess currents to be switched or overloads. The temperature limiter 40 or its switch 42 only has to switch the power of the first heating device 13 or interrupt it if an excess temperature threatens. As the maximum average power for the second heating device 15 is in a range for which no temperature limitation is necessary, it can still be operated if the first heating device 13 had to be switched off due to an otherwise excessive temperature.

Function

A detailed explanation has been given hereinbefore of the control of the individual heating devices 13 and 15, the on and off times for obtaining an average power and the case of a threatening excess temperature for the glass ceramic plate 18. The heating devices must be constructed and controlled in such a way that this is as simple as possible for the operator and the desired heating functionalities are ensured. In this connection details are given of the precise form of the drum controller 27 and cam disk 34, which are significant in this connection.

In the position shown in FIG. 2 both heating devices 13 and 15 are switched off, because the contacts 25 and 31 of switching devices 24 and 30 are separated. In order to now set a low cooking stage, the rotary spindle 23 is rotated counterclockwise using the rotary toggle 22. It is clear that in the case of counterclockwise rotation the circumference of the controller drum 27 decreases. Thus, the slider 26 and consequently the support for the central part of the snap-action spring of the first switching device 24 move downwards. A point arrives where the spring snaps round and the switching device 24 closes. The further the controller drum 27 is rotated counterclockwise, the lower downwards it is possible to press the slider 26. This also proportionally increases the duration of the further tripping for isolating the switching device 24, which signifies a higher cooking stage. This is explained in detail in EP 898 291 A to which express reference should be made.

In a first area 27*a* extending from 0° to approximately 140°, there is a continuous decrease in the radius of the controller drum from the highest value. To the increase area 27*a* bringing about the off state is connected a second area 27*b*, where the radius increases again to the extent that it corresponds to the radius in area 27*a*, where the lowest cooking stage is reached, that is the lowest average continuous output power generated by the first heating device 13 across the energy control device 21. This is just behind the outermost point of the controller drum 27 in area 27*a*. As from this increase there is once again a decrease in the radius in area 27*a* over substantially the entire remaining angular range up to somewhat before 3600, where once again the area 27*a* with the strong increase commences.

At the point or angle where the area 27*b* commences, the cam disk 34 has the start of area 34*b*. The latter extends from the same angle a of approximately 140° up to approximately 360°, where the radius is increased compared with the radius in area 34*a* and is roughly constant. The area extends roughly over an angle from approximately 0° to approximately 140°. If the slider 32 of the second switching device 30 engages on area 34*a*, then the contacts 31 are opened and the second heating device 15 switched off. An energy generation at the hotplate 19 only takes place via the first heating device 13. If by means of the second switching device 30 the full power of the second heating device 15 is switched, then it is recommended that it be constructed as a snap-action switch for an improved switching behaviour.

Figure 5:
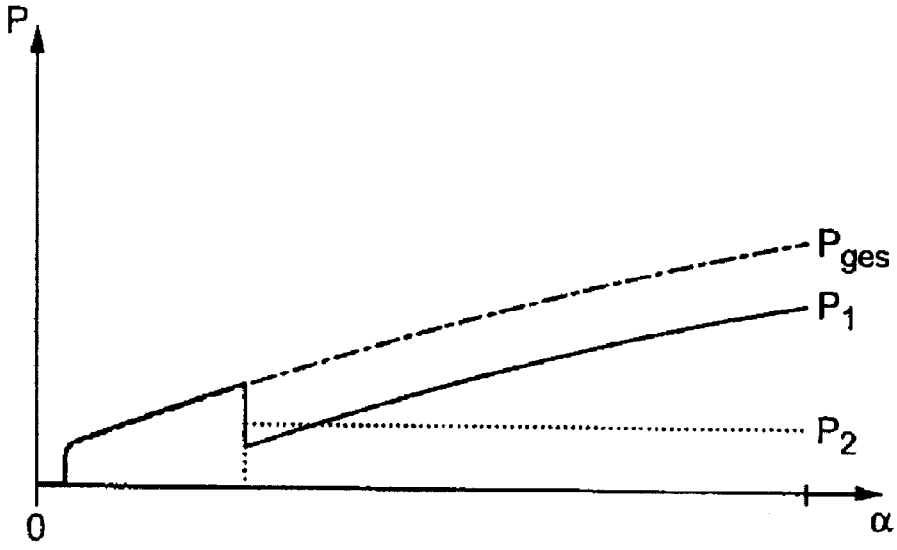
FIG. 5 A graph of the distribution of the average power as a function of the angular position of a setting on the energy control device of FIGS. 2*a* and 2*b*.

The graph of FIG. 5 plots the average powers P1 for the first heating device 13, P2 for the second heating device 15 and Pges for the complete hotplate 19 over the rotation angle. P2 is shown in dotted line form and Pges in dot-dash line manner. Over the rotation angle a of 0° to approximately 140° the power P1 rises from a specific starting value, for example somewhat over 100 Watt, to approximately 1,200 Watt at 140°. As a result of further rotation, the slider 26 with the first switching device 24 is again forced further upwards through the start of area 27*b* and namely to the extent of area 27*a* after the rise and with the lowest possible, switched-in, average power. This is once again somewhat above 100 Watt. As from this point the power P1 rises again due to the decreasing radius of area 27*b*, in the manner shown.

At angle 140° through the second area 34*b* at cam disk 34, the second switching device 30 is switched on and the second heating device 15 is activated. As is apparent from the graph, even with an increasing angle the power P2 is constant. The total power Pges results from the addition of P1 and P2. By the reduction of P1 roughly by the value of P2 at the angle 140°, there is overall a roughly constant, through path for the total power Pges. The value for P2 can be chosen as roughly 1100 Watt. P1 can be max. 2,100 Watt, so that in all at hotplate 19 a heating power of 3,200 Watt can be produced, which is clearly above the present maximum heating powers. In the case of an excess temperature of the glass ceramic plate 18, via switch 42 the temperature limiter 40 only separates the first heating device 13. However, the second heating device 15 continues to operate without any excess temperature risk.

The size of the hotplate 19 can be roughly 230 mm or can correspond to a conventional hotplate. For a voltage of 240 V, this normally represents a power of only 2,500 Watt, so that a heating power rise of more than one quarter is possible.

It is also noteworthy here that the cyclic operation of the energy control device 21 does not apply to the second heating device 15. This is switched on or off exclusively as a function of the angular position at the rotary spindle 23. This must be borne in mind when dimensioning the heating devices for a specific, average power.

Through the subdivision of the powers to be switched in accordance with FIG. 5 in the range smaller than 140° into only one control load to be switched in the usual way and with more than 140° into a basic load not to be switched, together with an additional control load flicker regulations are not infringed.

The covering of also the second heating device 15 by the sensor 41 of the temperature limiter 40 does not influence or disturb the function here. Although the second heating device 15 helps to raise the temperature, due to the choice of its maximum heating power as approximately 2.5 W/cm$^2$, even on reaching an excess temperature and subsequent switching off of the first heating device 13, it can continue to be operated without any problem. For some cooking processes continuous heating can even be advantageous, because it is more uniform.

In a variant of an energy control device construction it is possible by means of the cam disk 34 not to directly control the power switch for the second heating device 15 and instead to provide a signal switch, which only switches a low power. As a result a power relay can be controlled as the second switching device and switches on and off the second heating device 15. Thus, the energy control device casing only has to contain one high power switch, which improves the construction with respect to the insulation gaps or the like.

The invention claimed is:

1. An appliance for switching on and off several heating devices of a cooker, said heating devices being located on said cooker, said appliance comprising:

a cyclic energy control device for adjusting the cycle times of a first heating device, said energy control device having:

a first switching device with a tripping path and a first tripping point for said first switching device; and a second switching device with a second tripping path and a second tripping point for said second switching device and a spacing change for said first and second tripping paths of said switching devices, wherein said energy control device has a mechanism having an adjusting path for influencing said spacing change, said first and second tripping paths defining on or off times of said switching devices or a mutual ratio of said on or off times and at said second tripping point of said second tripping path, said second switching device for said second heating device is activated or switched on through said adjusting path.

2. Appliance according to claim 1, wherein at said second tripping point, said spacing change again sets said first tripping path for said first switching device at an initial value of a definition of said on or off times or said mutual ratio for again modifying said first tripping path with increasing said adjusting path.

3. Appliance according to claim 1, wherein said second tripping point for activating said second switching device is located on said second tripping path where a power of said first heating device averaged over several of said on and off times is at least as high as a power of said second heating device.

4. Appliance according to claim 1, wherein at said the second tripping point an adjustable, averaged power for said first heating device is less than half of a maximum, averaged power.

5. Appliance according to claim 1, wherein it has a temperature limiter, which is at least located in an action area of said first heating device and switches off said first heating device on exceeding a specific temperature.

6. Appliance according to claim 5, wherein said temperature limiter has a switch located in a connection path for said first heating device.

7. Appliance according to claim 1, wherein said cyclic energy control device is constructed for a rotary movement as an adjusting path, which is less than 360°.

8. Appliance according to claim 7, wherein said spacing change converts said rotary movement into a substantially linear tripping path.

9. Appliance according to claim 7, wherein said cyclic energy control device has a rotary spindle for adjustment purposes and on said rotary spindle a second trip for said second switching device is located at said second tripping point.

10. Appliance according to claim 1, wherein said first tripping path and said second tripping path change as a function of said adjusting path, which is the same for both said tripping paths.

11. Cooker with an appliance according to claim 1, having said first and said second heating devices, said cooker having a hob with a glass ceramic plate and radiant heaters as said heating devices below said glass ceramic plate, said second heating device having a maximum continuous output power of approximately 2.5 W/cm$^2$.

12. Cooker according to claim 11, wherein said two heating devices are electrically isolated from one another.

13. Cooker according to claim 11, wherein said heating devices are installed parallel to one another and are essentially located in the same surface area.

* * * * *